US012384595B2

(12) United States Patent
Martin

(10) Patent No.: US 12,384,595 B2
(45) Date of Patent: Aug. 12, 2025

(54) RE-USABLE CRATE SYSTEM

(71) Applicant: William Dee Martin, Phoenix, AZ (US)

(72) Inventor: William Dee Martin, Phoenix, AZ (US)

( * ) Notice: Subject to any disclaimer, the term of this patent is extended or adjusted under 35 U.S.C. 154(b) by 115 days.

(21) Appl. No.: 18/349,542

(22) Filed: Jul. 10, 2023

(65) Prior Publication Data

US 2024/0017881 A1 Jan. 18, 2024

Related U.S. Application Data

(60) Provisional application No. 63/388,413, filed on Jul. 12, 2022.

(51) Int. Cl.

| | |
|---|---|
| ***B65D 19/16*** | (2006.01) |
| ***B65D 19/00*** | (2006.01) |
| ***B65D 19/06*** | (2006.01) |
| ***B65D 19/38*** | (2006.01) |

(52) U.S. Cl.

CPC ..... *B65D 19/385* (2013.01); *B65D 19/0095* (2013.01); *B65D 19/06* (2013.01); *B65D 2519/00273* (2013.01); *B65D 2519/00293* (2013.01); *B65D 2519/00323* (2013.01); *B65D 2519/00373* (2013.01); *B65D 2519/00497* (2013.01); *B65D 2519/00532* (2013.01); *B65D 2519/00542* (2013.01); *B65D 2519/00606* (2013.01); *B65D 2519/00671* (2013.01); *B65D 2519/0098* (2013.01)

(58) Field of Classification Search

CPC ..... B65D 19/12; B65D 19/16; B65D 19/38; B65D 19/385; B65D 2519/00029; B65D 2519/00064; B65D 2519/00099

USPC ..... 206/386, 599, 600; 108/53.5

See application file for complete search history.

(56) References Cited

U.S. PATENT DOCUMENTS

| | | | | | |
|---|---|---|---|---|---|
| 2,686,645 | A | * | 8/1954 | Whitehurst | B65D 19/385 211/49.1 |
| 2,828,933 | A | * | 4/1958 | De Pew | B65D 19/385 211/49.1 |
| 3,159,116 | A | | 12/1964 | Skubic | |
| 3,289,613 | A | * | 12/1966 | Evans | B65D 19/385 108/53.5 |
| 3,500,770 | A | | 3/1970 | Skubic | |
| 3,576,169 | A | * | 4/1971 | DePew | B65D 19/385 108/53.5 |
| 3,855,944 | A | * | 12/1974 | Skubic | B65D 19/385 108/53.5 |
| 3,994,241 | A | * | 11/1976 | Evans | B65D 19/385 108/53.5 |

(Continued)

*Primary Examiner* — Luan K Bui

(74) *Attorney, Agent, or Firm* — Thorpe North & Western, LLP

(57) ABSTRACT

A re-usable crate system has a frame removably coupled to a pallet and extending above the pallet to form a crate to receive cargo over the pallet and at least partially between the frame. The frame has corner brackets at each corner of the pallet. Each corner bracket comprises a bottom plate proximate a bottom of the pallet, a top plate proximate a top of the pallet, and a pair of contiguous side walls extending between the top and bottom plates. The pair of side walls adjoin one another and forms a box with a pair of contiguous side openings opposite the pair of contiguous side walls. Each corner bracket has a pocket to receive a respective corner of the pallet.

20 Claims, 10 Drawing Sheets

(56) References Cited

U.S. PATENT DOCUMENTS

| | | | | |
|---|---|---|---|---|
| 4,756,138 | A * | 7/1988 | Karpisek | B65B 9/135<br>108/53.5 |
| 8,499,700 | B2 | 8/2013 | Schumacher | |
| 2003/0038052 | A1 | 2/2003 | Hahn | |
| 2018/0340368 | A1 | 11/2018 | Zwierzykowski | |

* cited by examiner

RE-USABLE CRATE SYSTEM

PRIORITY CLAIM

Priority is claimed to U.S. Provisional Patent Application Ser. No. 63/388,413, filed Jul. 12, 2022, which hereby incorporated herein by reference.

BACKGROUND

Shipping cost can be based on size and weight. The size can be determined by the footprint in the truck. Large items, such as doors, are often laid flat during shipping which increases the size and thus the cost. Sometimes, special crates are used that are expensive to fabricate. In addition, the wood from the crate is often wasted because the crates are not re-usable because it can be too costly to return ship an empty crate. The development of improved shipping containers and methods is an ongoing endeavor.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
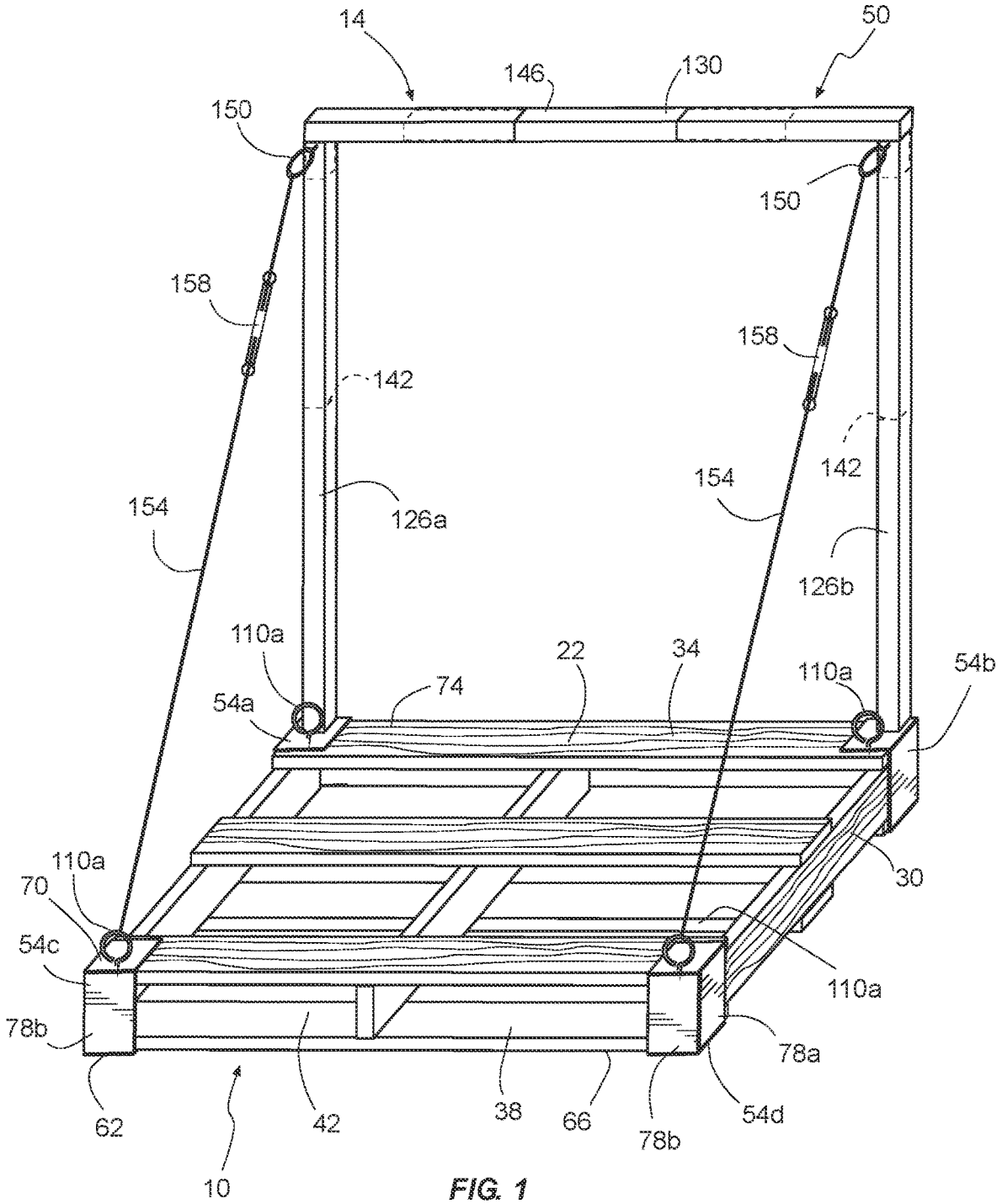
FIG. 1 is a perspective view of a re-usable crate system in accordance with one embodiment, shown with a frame in an expanded use configuration and mounted to a pallet.

Reference will now be made to the exemplary embodiments illustrated, and specific language will be used herein to describe the same. It will nevertheless be understood that no limitation of the scope of the invention is thereby intended.

DETAILED DESCRIPTION

Before invention embodiments are disclosed and described, it is to be understood that no limitation to the particular structures, process steps, or materials disclosed herein is intended, but also includes equivalents thereof as would be recognized by those ordinarily skilled in the relevant arts. It should also be understood that terminology employed herein is used for the purpose of describing particular examples only and is not intended to be limiting. The same reference numerals in different drawings represent the same element. Numbers provided in flow charts and processes are provided for clarity in illustrating steps and operations and do not necessarily indicate a particular order or sequence. Unless defined otherwise, all technical and scientific terms used herein have the same meaning as commonly understood by one of ordinary skill in the art to which this disclosure belongs.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

The invention provides a kit with a re-usable frame of upright braces that can be secured to an existing pallet to allow large cargo, such as doors, to be placed upright on the pallet, reducing the shipping footprint and shipping costs. The frame can be removed from the pallet and shipped back for re-use with minimal expense. In addition, the entire kit or frame can be packaged inside the structure of the pallet for return.

The pallet can be a standard wood pallet. The pallet can have a standard size, such as 48"×48"; 48"×40"; 42"×42"; etc. The pallet can also have a standard height or thickness, such as 4¾" or 5¾". Thus, the pallet can have a width and a length both greater than a height. The dimensions can be approximate. For example, a 48" pallet may actually be 47¼". In one aspect, the pallet can have a wood construction with three stringers or stringer boards, six top deck boards, and three to five bottom deck boards. In one aspect, the stringer boards can have cutout notches. The pallet can be a 2-way entry pallet where a forklift can lift the pallet from only two sides, or a partial 4-way pallet where a forklift can lift the pallet from all four sides, and a pallet jack from two sides.

The frame or braces can include a set (such as 4) of corner brackets that can fit over the corners of the pallet. The corner brackets can have top and bottom plates, and two contiguous side walls leaving two contiguous sides open to receive the corner of the pallet into an interior pocket.

In one aspect, the top plate can have an aperture. A retaining pin can extend through the aperture and engage the pallet to retain the corner bracket on the pallet. For example, the retaining pin can engage a side of the top deck board opposite an outer side of the corner bracket.

A ring can be carried by the corner bracket. The ring can be secured to the corner bracket.

In another aspect, the top plate can have a threaded aperture, such as a threaded nut welded to the top. A threaded eye-bolt can be threaded into the threaded aperture to secure the eye-bolt to the bracket. The eye-bolt can also extend through the top plate and into the pocket to act as a set screw by engaging a top of the pallet, thus securing the corner bracket to the corner of the pallet. The eye-bolt can provide the ring.

At least some of the corner brackets can have a post extending upward from the corner bracket. For example, there can be two back brackets with posts. Atop rail can extend between two proximal posts. The top rail can have fingers that can insert into open top ends of the posts. The rail can telescope and be secured with a set screw. Similarly, the posts can telescope. The ends of the top rail or the posts can have eyelets.

The rings and the eyelets can receive a cable or strap. The eye-bolts can have two purposes. First, the eye-bolts can be a place to attach a cable or strap. Second, the eye-bolts can screw into the pallet to secure the bracket to the pallet.

In one aspect, a cable or strap can extend between proximal front and back brackets. For example, a cable or strap can extend from a front bracket to the top rail of the back bracket. In one aspect, there can be a single cable or strap extending from a first ring of a first corner bracket to a first eyelet of back bracket, to a second eyelet of the back bracket, and to a second ring of a second corner bracket. In another aspect, a pair of cables can be on opposite sides of the pallet. The cables can be tightened with a turnbuckle. As another example, a strap can extend from the front bracket to the top rail of the back bracket. The strap can have a ratchet to tighten the strap.

In one aspect, both the rear length and height are adjustable, as well as the length of the cable or strap, for depth.

The brackets can be added to an existing pallet to form a crate to receive larger upright cargo, such as doors, between the cables and against the top rail. The brackets can be removed from the pallet after shipping and re-used by shipping the brackets back. In one aspect, the brackets, posts, bars and cable/strap can weigh around 22 Lbs. Thus, freight return can be reasonably priced. In addition, the brackets can be located in the structure of the pallets, i.e. under the top of the pallet, for return shipping.

The frame and the brackets can have different configurations for other shipping items. The configuration can be one-sided, two-sided or four sided. The brackets can also have a center column configuration coupling two pallets together. The brackets can have vertical channels to receive panels to form enclosed sides. The brackets can also be interconnected. The brackets can have two opposite pockets to joint two standard 4-foot pallets together to form an 8-foot pallet. Thus, the pallets can be sold back to recoup at least part of the cost of the pallets. Shipping pallets back to the distributor can be much more than the cost of the pallet itself.

In one aspect, the rear bar and riser can be formed of 16-gauge tube. In another aspect, the rear bar and rise alone cannot handle the weight of the cargo leaning against them. The cable or strap connect to the front and rear of the pallet can distribute the weight on to the corner brackets, making the crate extremely strong but light weight.

In another aspect, the kit, and the brackets, posts, rails and cable/strap can be broken down to a size or length not exceeding 48". Thus, one or multiple kits can be returned to the shipper on a single 4-foot square pallet, reducing the cost of return shipping.

Figure 9:
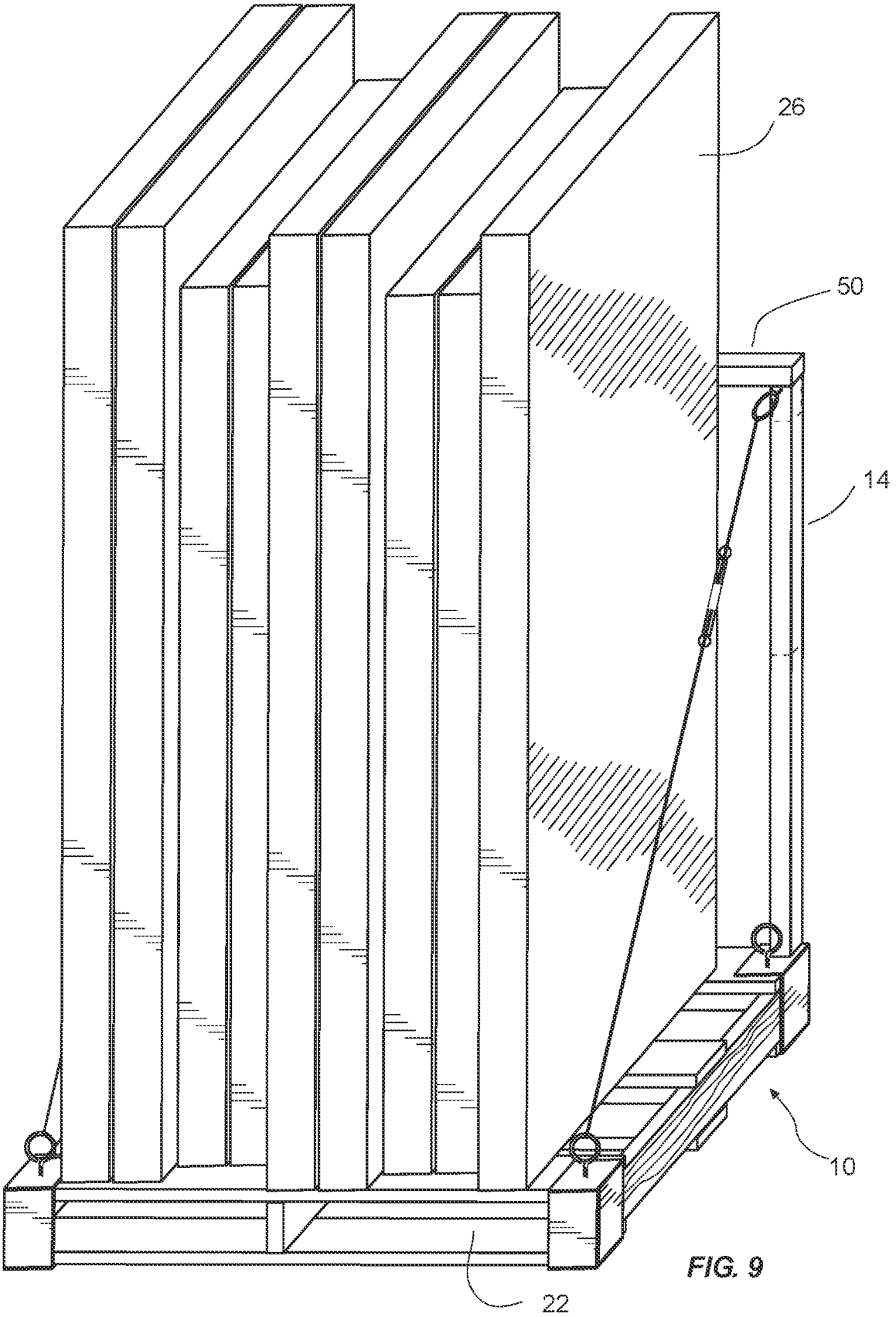
FIG. 9 is a perspective view of the re-usable crate system of FIG. 1, shown with cargo.

Referring to FIGS. 1-4, a re-usable crate system 10 with a frame 14 and a kit 18 (FIG. 10) of braces and a pallet 22 are shown to receive cargo 26 (FIG. 9). The pallet 22 can have a wood construction with a pair of lateral outer sides 30 formed by outer stringer boards, an array of upper slats 34 or top deck boards carried by and fastened to tops of the pair of lateral outer sides 30 or stringer boards and extending between the pair of lateral outer sides 30 or stringer boards, and an array of lower slats 38 or bottom deck boards fastened to bottoms of the pair of lateral outer sides 30 or stringer boards. The pallet 22 can have a width, a length and a height; with the width and the length being greater than the height. The pallet 22 can also have an interior volume 42 defined by the pair of lateral outer sides 30 or stringer boards, the array of upper slats 34 or top deck boards, and the array of lower slats 38 or bottom deck boards. The interior volume 42 of the pallet 22 can be substantially void. As described herein, the pallet 22 can have lateral openings 46 (FIG. 11) configured to receive the fork of a fork lift and/or pallet jack.

Figure 10:
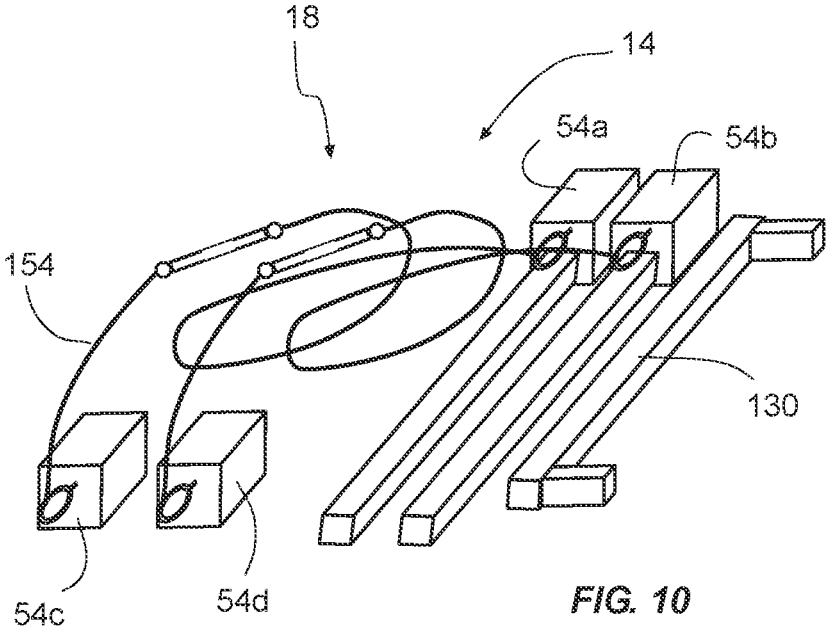
FIG. 10 is a perspective view of the frame of the re-usable crate system of FIG. 1, shown in a collapsed configuration.

The system 10 and the kit 18 can comprise a frame 14 removably coupled to the pallet 22. The frame 14 can extend above the pallet 22 to form a crate 50 to receive cargo 26 (FIG. 9) over the pallet 22 and at least partially between the frame 14. Thus, the frame 14 of the kit 18 and the system 10 can be secured to the pallet 22 and used to convert a standard pallet 22 into a shipping crate 50. Cargo 26 can be placed on the deck of the pallet 22, and between the frame 14 (FIG. 9). For example, doors or long windows can be place upright on the pallet 22, and against the frame 14 so that the frame 14 maintains them upright on the pallet 22. Thus, the cargo 26 can occupy a smaller footprint during shipping, rather than a longer crate. In addition, the frame 14 can be removed (FIG. 10) after shipping so that the pallet 22 and/or the frame 14 can be reused/recycled. The frame 14 can collapse when removed from the pallet 22 to form a smaller package for return shipping, as shown in FIG. 10.

The frame 14 can comprise a plurality of corner brackets 54*a-d* that can be positioned at each corner 58*a-d* (FIG. 11) of the pallet 22. The corner brackets 54*a-d* can engage and be secured to the corners of the pallet 22. Each corner bracket 54 (FIG. 2) can comprise: a bottom plate 62 proximate a bottom 66 of the pallet 22; a top plate 70 spaced-apart from the bottom plate 62 and proximate a top 74 of the pallet 22; and a pair of contiguous side walls 78*a-b* extending between the top and bottom plates 70 and 62. The pair of side walls 78*a-b* can adjoin one another and can be oriented at a right angle with respect to one another. Thus, each corner bracket 54 can form a box with a pair of contiguous side openings 82*a-b* opposite the pair of contiguous side walls 78*a-b*. Each corner bracket 54 can have a pocket 86 to receive the respective corner of the pallet 22. Each corner bracket 54 can surround the corner of the pallet 22 to form a secure connection. In one aspect, the corner bracket 54 can be formed by metal plate welded together.

In one aspect, each top plate 70 can have an aperture 90. In another aspect, each top plate 70 can have a threaded aperture 90. In one aspect, the top plate 70 can have an aperture 90 with a threaded nut 94 welded over the aperture.

In one aspect, a retaining pin 96 can extend through the aperture 90 and engage the pallet 22 to retain the corner bracket 54 on the pallet 22. For example, the retaining pin 96 can engage a side and inside edge of the upper slat 34 opposite an outer side (such as wall 78*b*) of the corner bracket 22. In addition, the retaining pin 96 can engage a side an inside edge of the lateral outer side 30 opposite an outer side (such as wall 78*a*) of the corner bracket 22. The pin 96 can have an enlarged head abutting to the top plate 70 when inserted.

Figure 2:
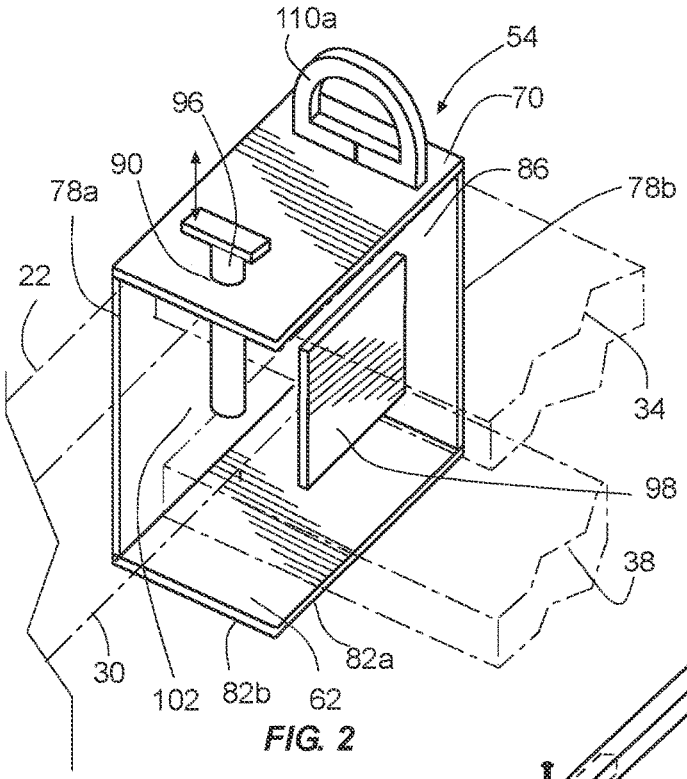
FIG. 2 is a perspective view of a corner bracket of the re-usable crate system of FIG. 1.
Figure 4:
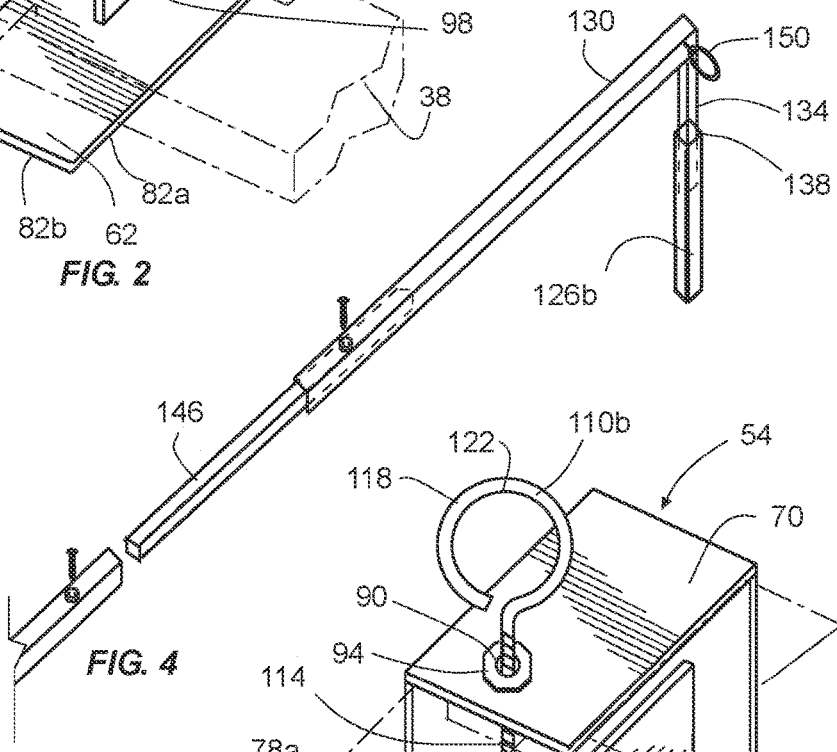
FIG. 4 is a partial detailed perspective view of the frame of the re-usable crate system of FIG. 1.
Figure 3:
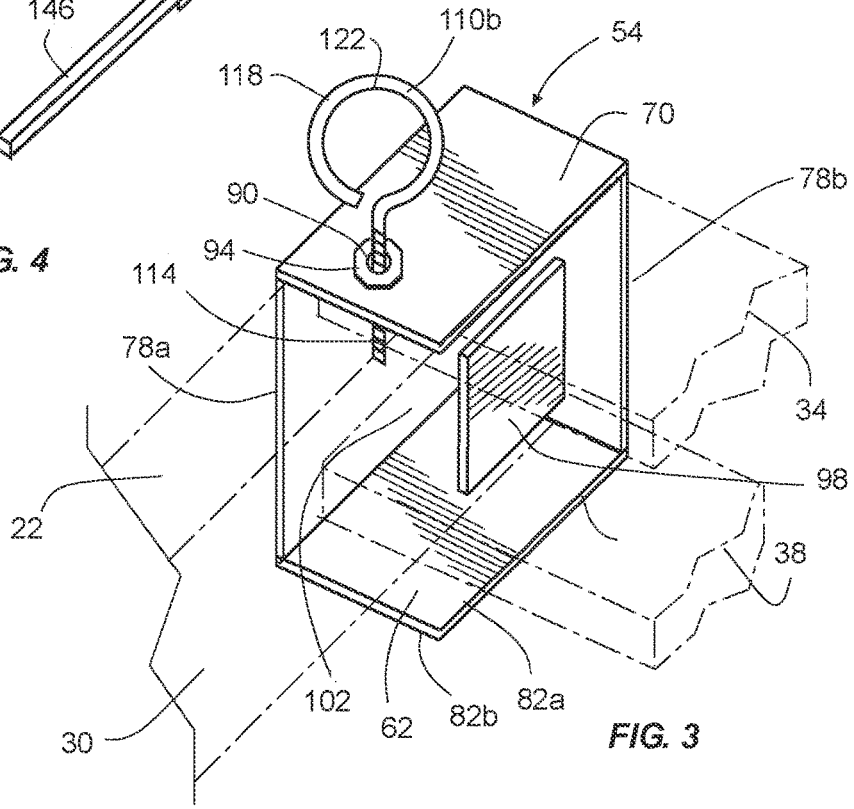
FIG. 3 is a perspective view of another corner bracket of the re-usable crate system of FIG. 1 in accordance with another embodiment.

In another aspect, referring to FIG. 2, each corner bracket 54 can further comprise a plate receiver 98 in the pocket 86 and extending from one of the walls 78*b* to define a gap 102 between the plate receiver 98 and the other wall 78*a*. The plate receiver 98 can be positioned, and the gap 102 can be sized, to receive an end of one of the lateral outer sides 30 or stringer boards of the pallet 22, as shown in FIG. 3. Spaces 106 can be formed between the top and bottom of the plate receiver 98 and the top and bottom plates 70 and 62 to accommodate the upper and lower slates 34 and 38, as shown in FIG. 3. Thus, the plate receiver 98 can resist movement between the corner bracket 54 and the pallet 22 in at least one direction.

In one aspect, referring again to FIGS. 1 and 2, each corner bracket 54 can have a ring 110*a* carried by the corner bracket 54. The ring 110*a* can be welded to the top plate 70. The ring 110*a* can be a shackle. Thus, the ring 110*a* can be fixed with respect to the top plate 70 and the corner bracket 54. In another aspect, the ring 110*a* can be pivotally coupled to the top plate 70 and pivotal with respect to the corner bracket 54. The rings 110*a* can be loops or hooks. The rings 110*a* can allow the multiple corner brackets 54*a-d* to be coupled together to further form the crate 50 and to further strengthen the pallet 22.

In another aspect, referring to FIG. 3, each corner bracket 54 can have an eye-bolt 110*b* carried by the corner bracket 54. Each eye-bolt 110*b* can have a threaded shank 114 threaded into the threaded aperture 90 to secure the eye-bolt 110*b* to the respective corner bracket 54. In addition, the eye-bolt 110*b* and the shank 114 can extend through the top plate 70 and into the pocket 86 to engage the top 38 of the pallet 22 to secure the corner bracket 54 to the corner of the pallet 22. The eye-bolt 110*b* can be rotatable with respect to the corner bracket 54 to secure and release the corner bracket 54 and the pallet 22. In one aspect, each eye-bolt 110*b* can have a head 118 with an aperture 122 to form the hook or loop. The eye-bolts 110*b* can allow the multiple corner brackets 54*a-d* to be coupled together to further form the crate 50 and to further strengthen the pallet 22.

The frame 14 can also comprise posts 126 carried by and extending from the corner brackets. In one aspect, a pair of posts 126*a-b* can carried by a pair of proximate corner brackets 54*a-b*. In another aspect, posts 12*a-d* can extend from all four corner brackets 54*a-d*, as described herein and shown in FIGS. 5 and 6. Each post 126 can extend upward from the respective corner bracket 54.

A top rail or bar 130 can be carried by and can extend between a pair of proximal posts 126*a-b*. In one aspect, the top rail or bar 130 can have fingers 134 that insert into open top ends 138 of the pair of posts 126*a-b*. In another aspect, the fingers 134 can be elongated and the top rail or bar 130 can be selectively elevated with respect to the posts 126*a-b* so that the top rail or bar 130, and thus the posts 126*a-b*, have a selective height to match the cargo 26. Thus, the posts 126*a-b* can have a pair of telescoping sections 142. In another aspect, the top rail or bar 130 can have a pair of telescoping sections 146. Thus, the length of the top rail or bar 130 can be selected to match the length of the pallet 22.

In one aspect, the ends of the top rail or bar 130 can have hooks or loops, such as eyelets 150. In another aspect the tops of the posts 126*a-b* can have hooks or loops, such as eyelets 150. The frame 14 can have at least one cable or strap 154 that can extend between the eyelets 150 of the top rail or bar 130 or the posts 126*a-b*, and the rings 110*a* or eye-bolts 110*b* of opposite corner brackets 54*c-d*. For example, a single cable or strap 154 can extend diagonally through the eyelets 150 and the rings 110*a* or eye-bolts 110*b*. As another example, a pair of cables 154 can be positioned on opposite sides of the pallet 22 and can extend diagonally from the eyelets 150 of the top rail or bar 130 to the eye-bolts 110 of the proximal and opposite corner brackets 54*c-d*. In one aspect, each cable 154 can have a turnbuckle 158 to tighten the cable 154. In another aspect, each strap can have a ratchet to tighten the cable 154.

The frame 14, and the corner brackets 54*a-d*, and the posts 126*a-b* and top rails 130, can have multiple configurations. In one aspect, as shown in FIG. 1, the frame 14 can be a one-sided crate 50 and can have: four corner brackets 54*a-d* at each corner of the pallet 22; a pair of posts 126*a-b* carried by a pair of proximate corner brackets 54*a-b*; a top rail or bar 130 carried by and extending between the pair of posts 126*a-b*; and at least one cable or strap 154 extending diagonally from the eyelets 150 of the top rail or bar 130 to the rings 110*a* or eye-bolts 110*b* of the proximal and opposite corner brackets 54*c-d*.

Figure 5:
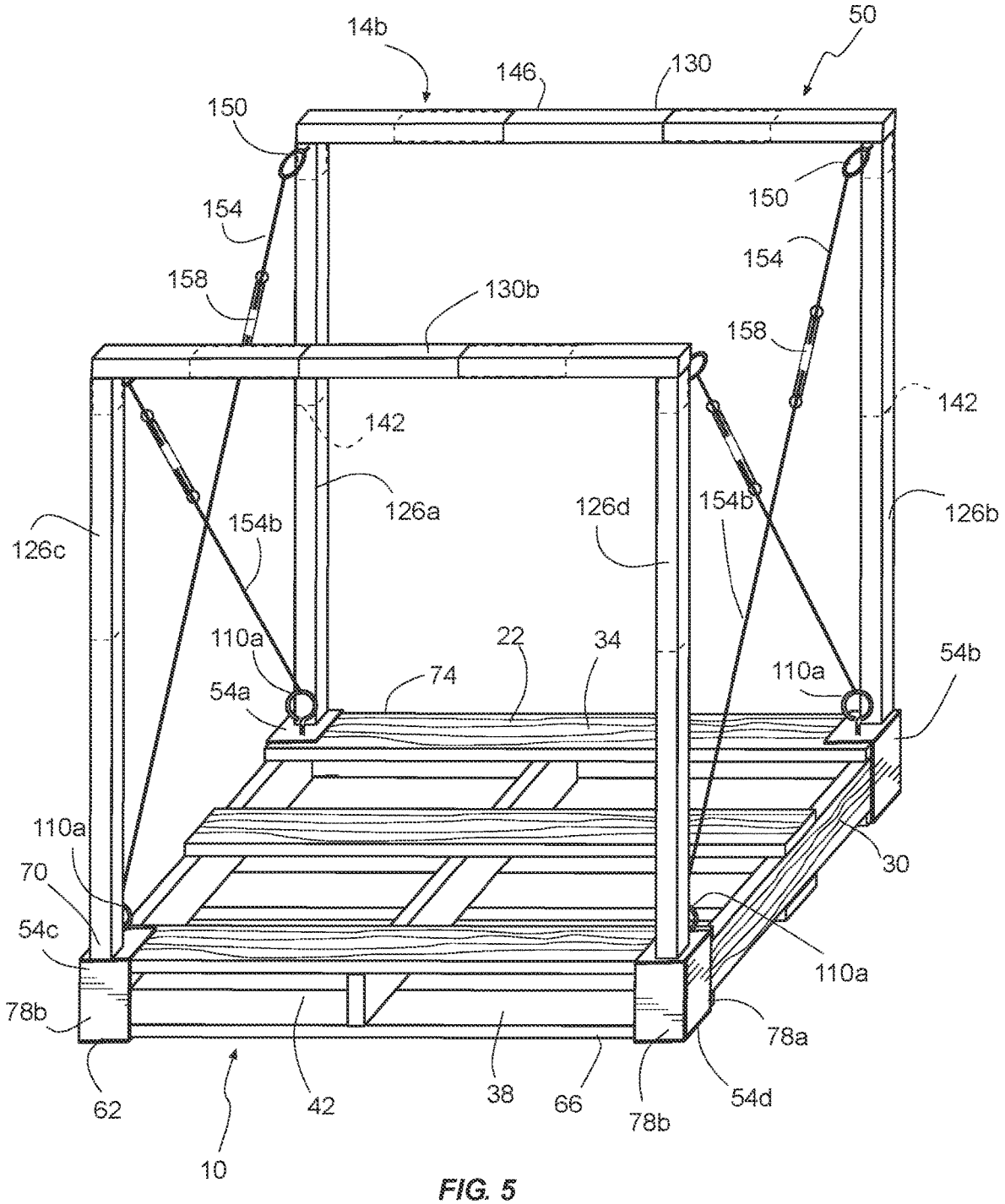
FIG. 5 is a perspective view of another re-usable crate system in accordance with another embodiment.

Referring to FIG. 5, the frame can be a two-sided frame 14*b* and can have: four corner brackets 54*a-d* at each corner of the pallet 22; a first pair of posts 126*a-b* carried by a first pair of proximate corner brackets 54*a-b*; a first top rail or bar 130 carried by and extending between the first pair of posts 126*a-b*; a first cables or strap 154 extending diagonally from the eyelets 150 of the first top rail or bar 130 to the rings 110*a* or the eye-bolts 110*b* of the first proximal and opposite corner brackets or shoes 54*c-d*; a second pair of posts 126*c-d* carried by a second pair of proximate corner brackets 54*c-d*; a second top rail or bar 130*b* carried by and extending between the second pair of posts 126*c-d*; and a second cable or strap 154*b* extending diagonally from the eyelets 150 of the second top rail or bar 130*b* to the rings 110*a* or the eye-bolts 110*b* of the first proximal and opposite corner brackets 54*a-b*.

Figure 6:
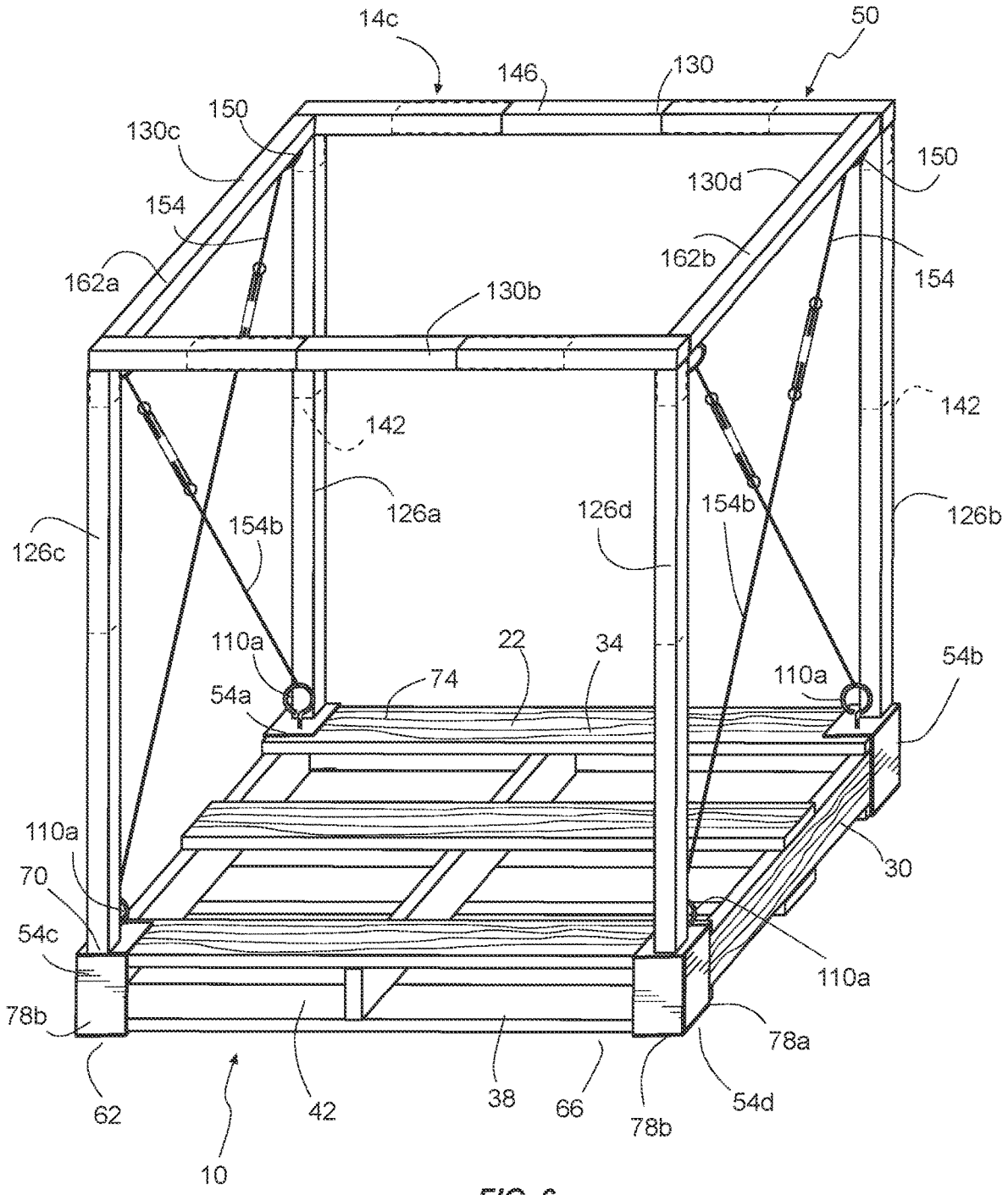
FIG. 6 is a perspective view of another re-usable crate system in accordance with another embodiment.

Referring to FIG. 6, the frame can be a four-sided frame 14*c* and can be configured as described with respect to the two-sided frame 14*b*, but also have four top rails or bars 130*a-d*. For example, a pair of cross-bars 162*a-b* can be located on opposite sides of the pallet 22 and can extend between the first and second pairs of posts 126*a-b* and 126*c-d*

Figure 7:
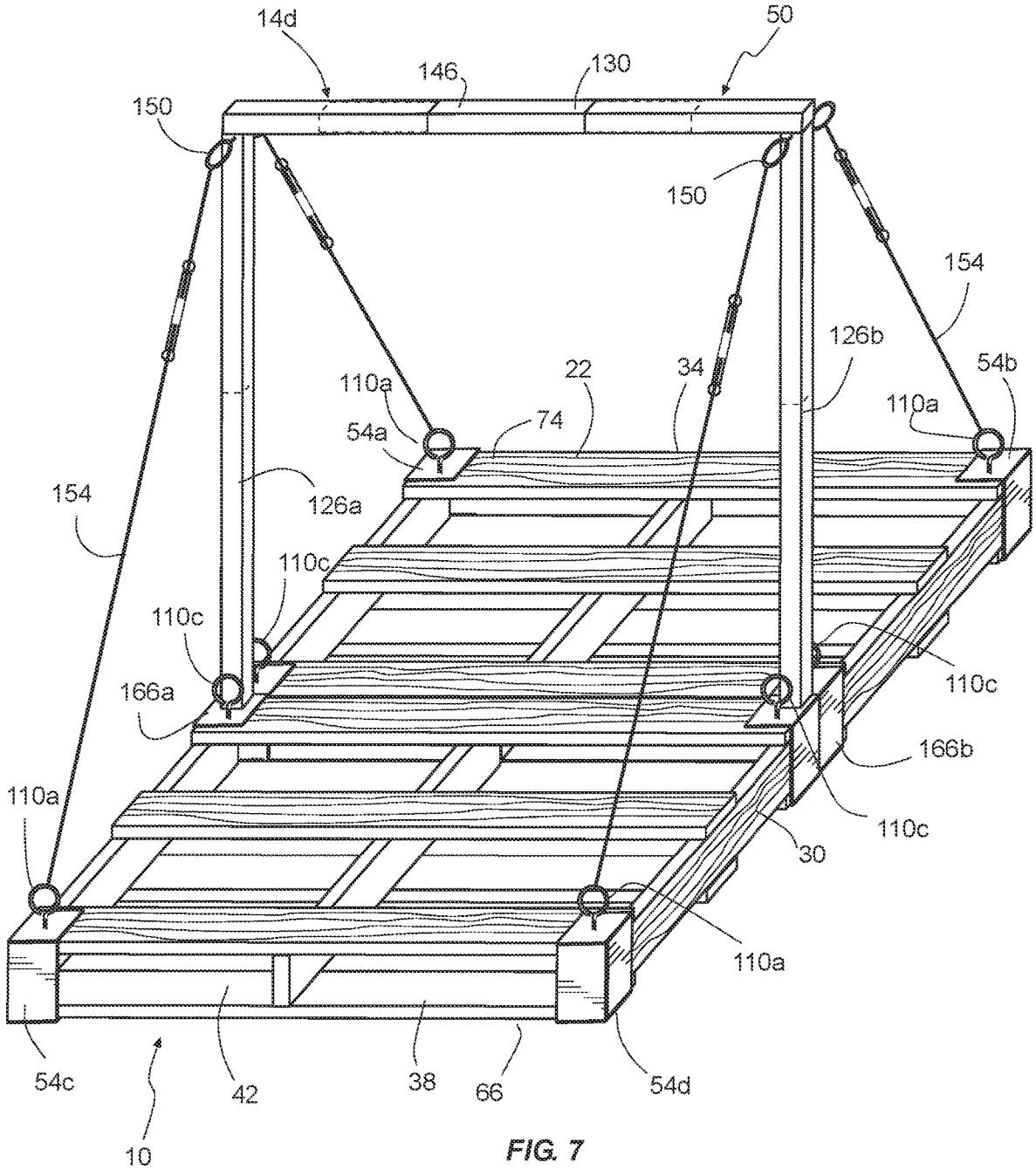
FIG. 7 is a perspective view of another re-usable crate system in accordance with another embodiment.
Figure 8:
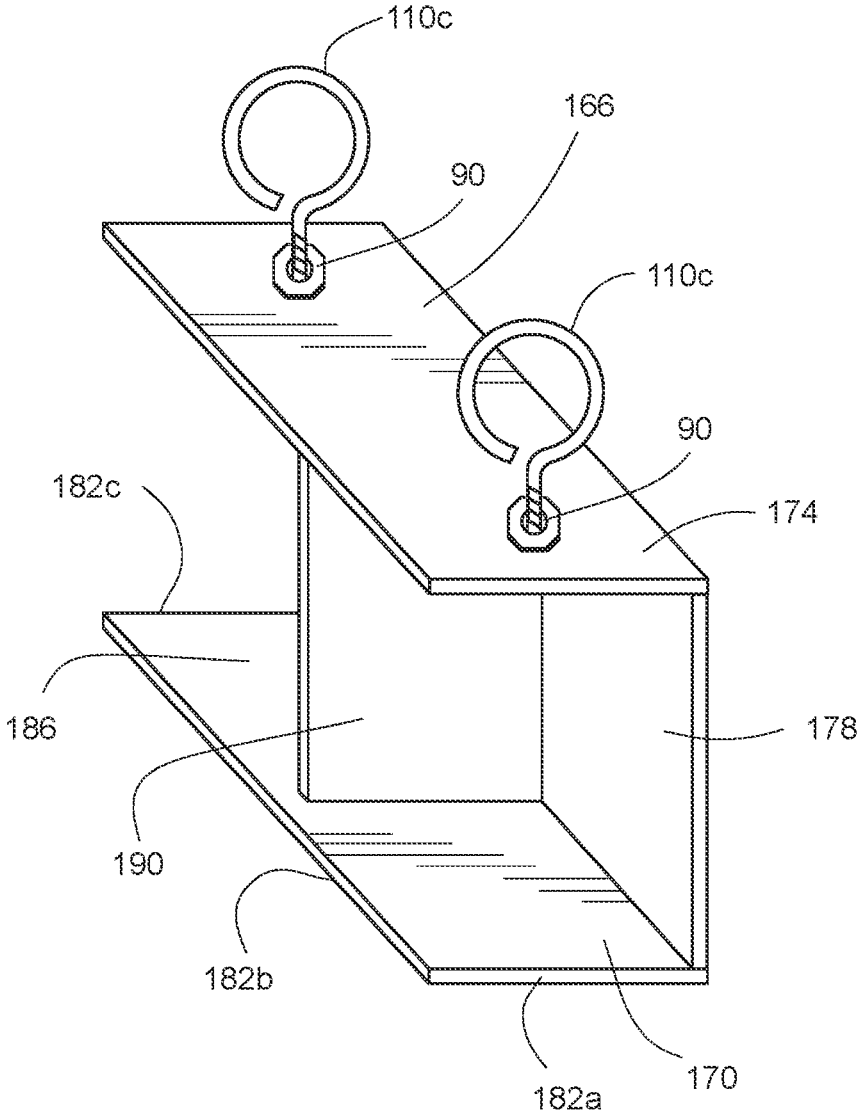
FIG. 8 is a perspective view of a joiner of the re-usable crate system of FIG. 8.

Referring to FIGS. 7 and 8, the frame 14*d* can comprise a pair of joiners 166*a-b*. In one aspect, the joiners 166*a-b* can be coupled between a pair of pallets 22*a-b* to removably join the pair of pallets together end-to-end to form a single, long pallet. Each joiner 166 can comprise: a bottom plate 170 proximate bottoms 60 of the pallets 22*a-b*; a top plate 174 spaced-apart from the bottom plate 170 and proximate tops 74 of the pallets 22*a-b*; and a side wall 178 extending between the top and bottom plates 174 and 170. Each joiner 166 can form a box with three contiguous side openings 182*a-c*. Each joiner 166 can have a pocket 186 to receive proximate corners of the pair of pallets 22*a-b*. In addition, each joiner 166 can have a septum 190 extending between the top and bottom plates 174 and 170 and separating the pocket 186 into a pair of pockets. The proximate corners of the pair of pallets 22*a-b* can abut to the septum 190. The top plate 174 can have a pair of threaded apertures 90 spaced-apart from one another. A pair of bolts 110*c* can be carried by each joiner 166. Each bolt 110*c* can have a threaded shank 114 threaded into the threaded aperture 90 to secure the bolt 110 to the respective joiner 166. The bolt 110*c* can extend through the top plate 174 and into the pocket 186 to engage a top of the pallet 22*a-b* to secure the joiner 166 to the corner of the pallets 22*a-b*. The bolt 110*c* is rotatable with respect to the joiner 166 to secure and release the joiner 166 and the pallets 22*a-b*. In addition, each bolt 110*c* can have a head 118 with an aperture 122.

In one aspect, the pair of joiners 166*a-b* can have a pair of posts 126*a-b* carried by and extending from the pair of joiners 166*a-b*. Each post 126*a-b* can extend upward from the respective joiner 166*a-b*. A top rail or bar 130 can be carried by and can extend between a pair of posts 126*a-b*.

In another aspect, the frame can be a center column frame 14*d* used with a pair of pallets 22*a-b*. The pallets 22*a-b* can be joined by the joiners 166. The frame 14*d* can comprise: four corner brackets 54*a-d* at each corner of the pallets

22*a-b*; the pair of joiners 166*a-b*; a pair of posts 126*a-b* carried by the pair of joiners 166*a-b*; a top rail or bar 130 carried by and extending between the pair of posts 126*a-b*; and four cables 154 extending diagonally from the eyelets 150 of the top rail or bar 130 to the eye-bolts 110 of the four corner brackets 54*a-d*. Thus, cargo 26 can be stacked on both pallets 22*a-b* and leaned against the top rail or bar 130.

Figure 11:
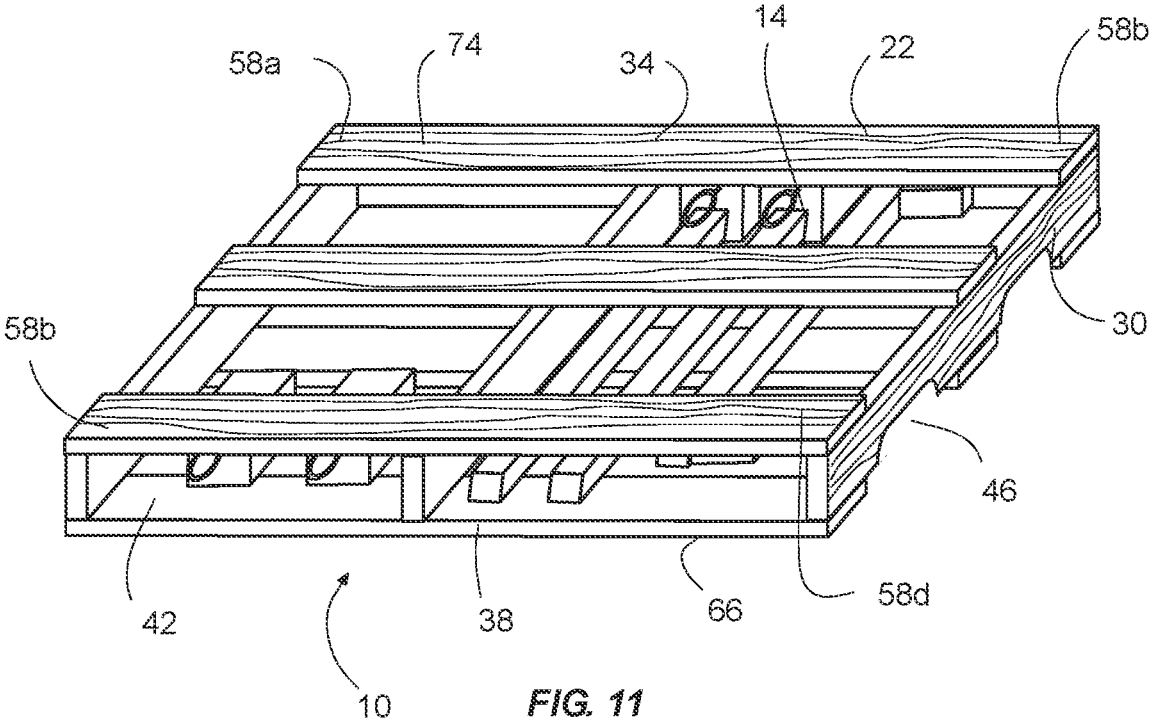
FIG. 11 is a perspective view of the re-usable crate system of FIG. 1, shown with the frame in the collapsed configuration and received in an interior volume of the pallet.

As described herein, the frame 14*a-d* can have an expanded use configuration with the corner brackets 54*a-d* mounted to the corners of the pallet 22 and configured to receive cargo 26 therein, as shown in FIGS. 1-5-7 and 9. In addition, the frame 14*a-d* can have a collapsed configuration with the corner brackets 54*a-d* removed from the corners of the pallet 22, as shown in FIG. 10. In another aspect, the frame 14*a-d* can be received in the interior volume 42 of the pallet 22 in the collapsed configuration, as shown in FIG. 11.

Figure 12:
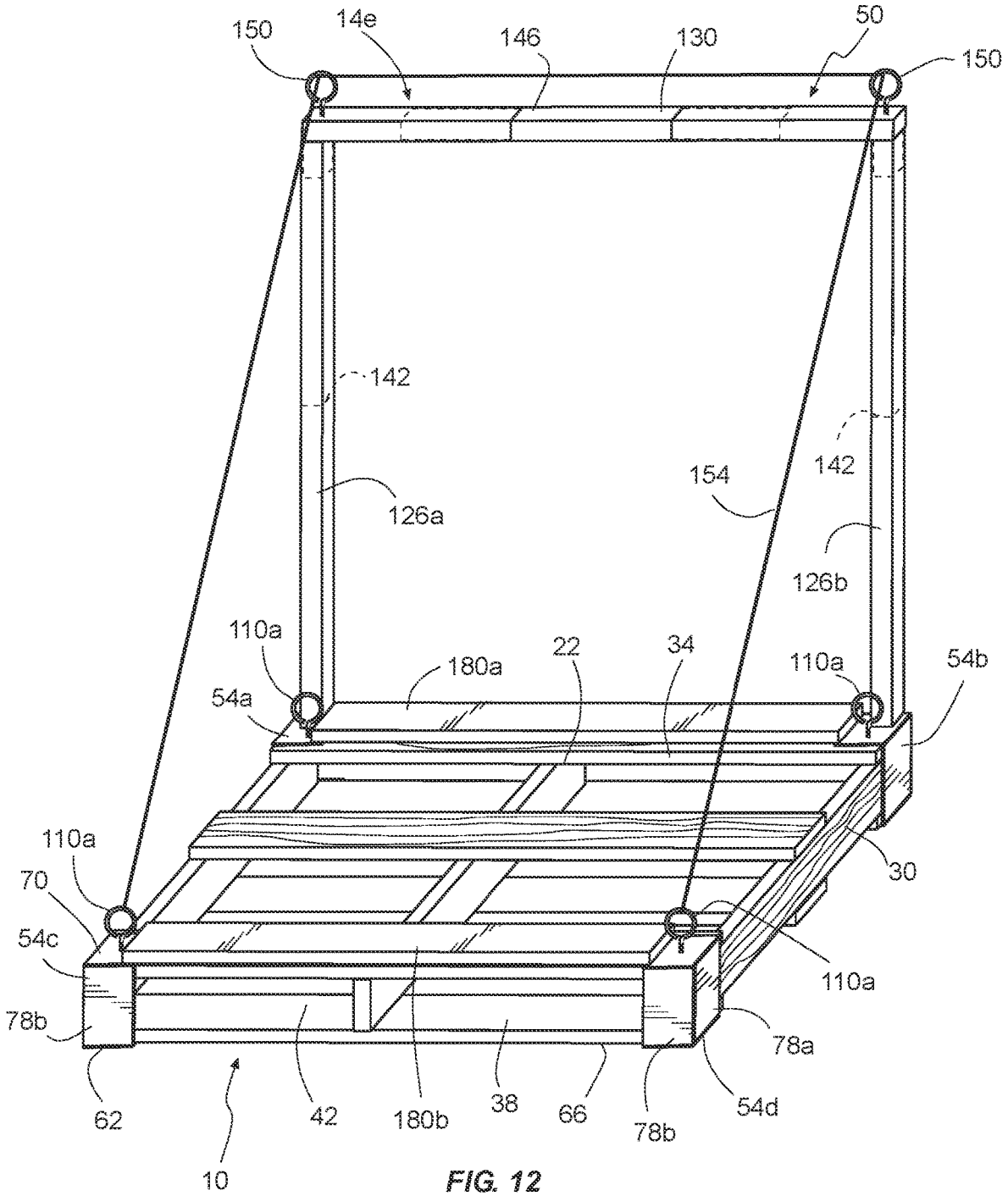
FIG. 12 is a perspective view of another re-usable crate system in accordance with another embodiment.

Referring to FIG. 12, the frame 14*e* can also comprise lower bars 180*a-b* secured to and extending between proximate lateral corner brackets 54*a-b* and 54*c-d* for form end brackets. In addition, the eyelets 150 can be positioned atop the top rail 130 and a single cable 154 can extend between the eye bolts 110 and the eyelets 150.

Figure 13:
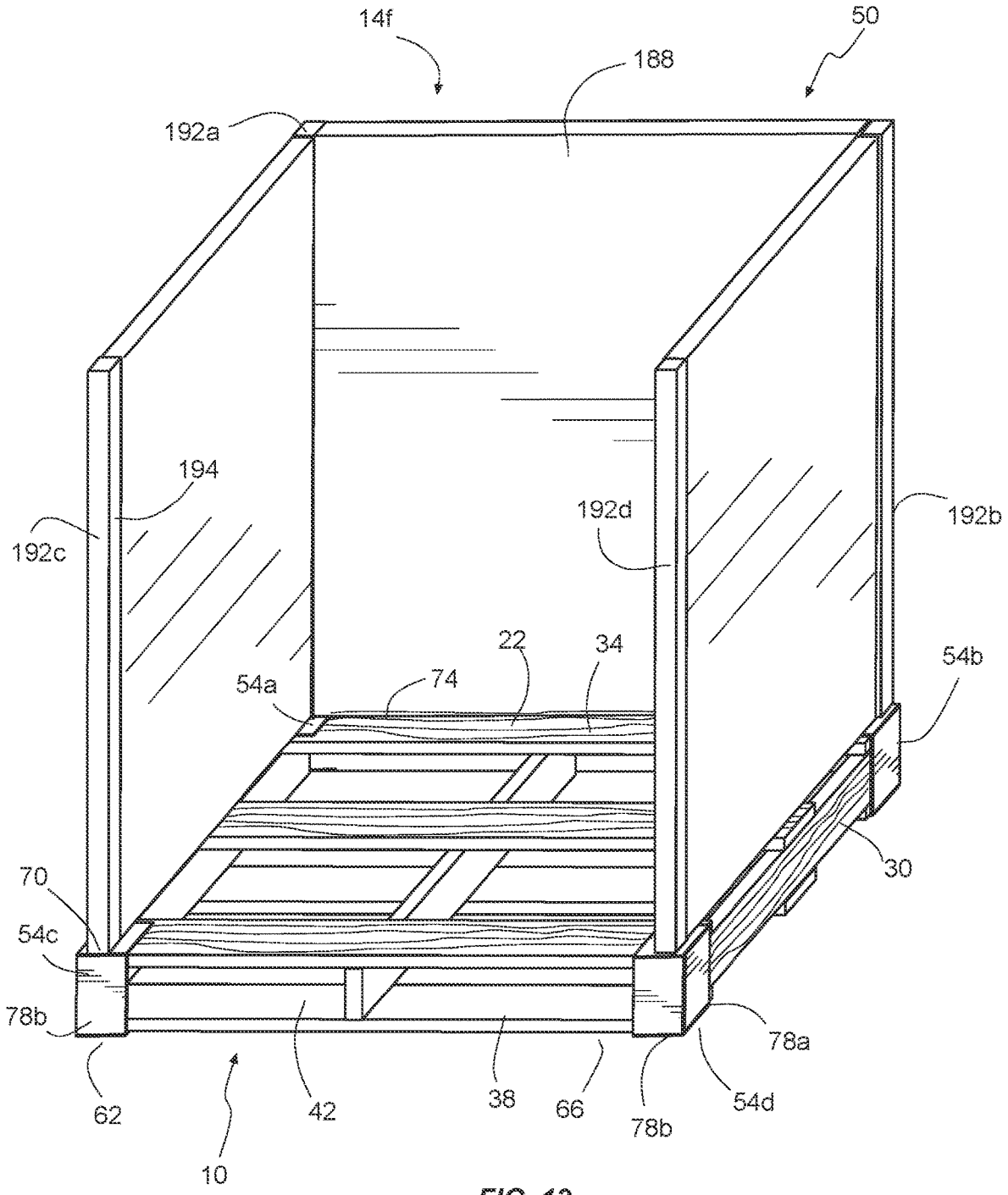
FIG. 13 is a perspective view of another re-usable crate system in accordance with another embodiment.

Referring to FIG. 13, the frame 14*f* can also comprise at least one panel 188 between proximate posts 192*a-d*. The posts 192*a-d* can have channels 194 facing towards proximate posts 192*a-d* to receive the panel 188 therebetween. The panel 188 can be solid or mostly solid to help retain cargo 26 in the crate 50 and on the pallet 22. The panels 188 can extend wholly or partially around a lateral perimeter of the frame 14*f*.

As used in this specification and the appended claims, the singular forms ("a," "an" and "the" include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. When using an open ended term in the specification, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, the term "about" is used to provide flexibility to a numerical range endpoint by providing that a given value may be "a little above" or "a little below" the endpoint. It is understood that express support is intended for exact numerical values in this specification, even when the term "about" is used in connection therewith.

The terms "interference fit" and "friction fit" and "press-fit" are terms of art used interchangeably herein to refer to deliberately causing, increasing and/or using friction to deliberately resist movement. An interference fit or friction fit is different than and great than the existence of friction. While friction may exist between any two surfaces, is often desirable to do all one can to reduce this friction. An interference fit or friction fit can be distinguished from naturally occurring friction by being actually deliberately caused and increased. An interference fit can be created by dimensioning engaging parts so that their surfaces tightly bear against one another. A friction fit can be created by surface roughness that is rougher.

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples. In the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed is:

1. A re-usable crate system, comprising:

a pallet having a wood construction with a pair of lateral outer sides, an array of upper slats carried by and fastened to tops of the pair of lateral outer sides and extending between the pair of lateral outer sides, and an array of lower slats fastened to bottoms of the pair of lateral outer sides, the pallet having a width, a length and a height, the width and the length being greater than the height, the pallet having an interior volume defined by the pair of lateral outer sides, the array of upper slats and the array of lower slats that is substantially void, the pallet having lateral openings configured to receive a fork of a fork lift;

a frame removably coupled to the pallet and extending above the pallet to form a crate configured to receive cargo over the pallet and at least partially between the frame; the frame comprising:

corner brackets at each corner of the pallet, each corner bracket comprising a bottom plate proximate a bottom of the pallet, a top plate spaced-apart from the bottom plate and proximate a top of the pallet, and a pair of contiguous side walls extending between the top and bottom plates, the pair of side walls adjoining one another and being oriented at a right angle with respect to one another, each corner bracket forming a box with a pair of contiguous side openings opposite the pair of contiguous side walls, each corner bracket having a pocket to receive a respective corner of the pallet;

each corner bracket further comprises:

an aperture in the top plate;

a pin carried by the corner bracket and insertable through the aperture and engaging an upper slat of the pallet to secure the corner bracket to a respective corner of the pallet, the pin having an enlarged head abutting to the top plate; and a ring carried by the corner bracket.

2. The re-usable crate system in accordance with claim 1, further comprising:

a pair of posts carried by a pair of proximate corner brackets, the pair of posts extending upward from the pair of proximate corner brackets;

eyelets located adjacent ends of the pair of posts; and at least one cable or strap extending diagonally on opposite sides of the pallet from the eyelets to the rings of opposite corner brackets.

3. The re-usable crate system in accordance with claim 2, further comprising:

each cable or strap having a turnbuckle or ratchet, respectively, configured to tighten the cable or strap.

4. The re-usable crate system in accordance with claim 2, further comprising:

a top rail carried by and extending between the pair of posts; and the top rail having fingers that insert into open top ends of the pair of posts.

5. The re-usable crate system in accordance with claim 4, further comprising:

the top rail having a pair of telescoping sections.

6. The re-usable crate system in accordance with claim 4, wherein:

the eyelets are at ends of the top rail.

7. The re-usable crate system in accordance with claim 4, further comprising:

the pair of posts being telescoping posts configured to vary an elevational height of the top rail with respect to the pallet.

8. The re-usable crate system in accordance with claim 4, wherein the pair of posts is a first pair of posts, the top rail is a first top rail, and the at least one cable or strap is a first cable or strap; and further comprising:

a second pair of posts opposite the first pair of posts and carried by a pair of opposite proximate corner brackets;

a second top rail opposite the first top rail and carried by and extending between the second pair of posts;

second eyelets at ends of the second top rail or the second pair of posts; and at least one second cable or strap extending diagonally on opposite sides of the pallet from the second eyelets to rings of the opposite corner brackets.

9. The re-usable crate system in accordance with claim 8, further comprising:

a pair of cross-bars on opposite sides of the pallet and extending between the first and second pairs of posts.

10. The re-usable crate system in accordance with claim 1, further comprising:

the frame having:

an expanded use configuration with the corner brackets mounted to the corners of the pallet and configured to receive cargo therein; and a collapsed configuration with the corner brackets removed from the corners of the pallet.

11. The re-usable crate system in accordance with claim 10, wherein the frame is received in the interior volume of the pallet in the collapsed configuration.

12. The re-usable crate system in accordance with claim 1, further comprising:

a pair of pallets positioned proximate one another;

a pair of joiners coupled between the pair of pallets and removably joining the pair of pallets together to form a single, long pallet;

each joiner comprising a bottom plate proximate the bottom of the pallets, a top plate spaced-apart from the bottom plate and proximate the top of the pallets, and a side wall extending between the top and bottom plates, each joiner forming a box with three contiguous side openings, each joiner having a pocket to receive proximate corners of the pair of pallets, each top plate having a pair of threaded apertures spaced-apart from one another;

each joiner comprising a septum extending between the top and bottom plates and separating the pocket into a pair of pockets receiving the proximate corners of the pair of pallets; and a pair of bolts carried by each joiner, each bolt threaded into the threaded aperture to secure the bolt to the respective joiner, the bolt extend through the top plate and into the pocket and engaging a top of the pallet to secure the joiner to the corner of the pallet, the bolt being rotatable with respect to the joiner to secure and release the joiner and the pallet.

13. The re-usable crate system in accordance with claim 12, further comprising:

a pair of posts carried by the pair of joiners, the pair of posts extending upward from the pair of joiners;

a top rail carried by and extending between the pair of posts;

eyelets at ends of the top rail or the pair of posts; and a cable or strap extending on opposite sides of the pallet and extending diagonally from the eyelets to the corner brackets.

14. The re-usable crate system in accordance with claim 1, wherein each corner bracket further comprises:

a plate receiver in the pocket and extending from one of the walls and defining a gap between the plate receiver and the other wall, the gap sized to receive an end of one of the lateral outer sides of the pallet; and the plate receiver configured to resist movement between the bracket and the pallet in at least one direction.

15. The re-usable crate system in accordance with claim 1, further comprising:

each top plate having a threaded aperture; and eye-bolts carried by the corner brackets, each eye-bolt having a threaded shank threaded into a respective threaded aperture to secure the eye-bolt to a respective corner bracket, the shank extend through the top plate and into the pocket and engaging the top of the pallet to secure the corner bracket to the corner of the pallet, the eye-bolt being rotatable with respect to the corner bracket to secure and release the corner bracket and the pallet, each eye-bolt having a head with an aperture.

16. A re-usable crate system, comprising:

a pallet having a wood construction with a pair of lateral outer sides, an array of upper slats carried by and fastened to tops of the pair of lateral outer sides and extending between the pair of lateral outer sides, and an array of lower slats fastened to bottoms of the pair of lateral outer sides, the pallet having a width, a length and a height, the width and the length being greater than a height, the pallet having an interior volume defined by the pair of lateral outer sides, the array of upper slats and the array of lower slats that is substantially void, the pallet having lateral openings configured to receive a fork of a fork lift;

a frame removably coupled to the pallet and extending above the pallet to form a crate configured to receive cargo over the pallet and at least partially between the frame; the frame comprising:

corner brackets at each corner of the pallet, each corner bracket comprising a bottom plate proximate a bottom of the pallet, a top plate spaced-apart from the bottom plate and proximate a top of the pallet, and a pair of contiguous side walls extending between the top and bottom plates, the pair of side walls adjoining one another and being oriented at a right angle with respect to one another, each corner bracket forming a box with a pair of contiguous side openings opposite the pair of contiguous side walls, each corner bracket having a pocket to receive a respective corner of the pallet, each top plate having an aperture;

rings carried by the corner brackets;

pins carried by the corner brackets and insertable through the apertures and engaging an upper slat to secure the corner brackets to respective corners of the pallet;

a pair of posts carried by a pair of proximate corner brackets, each post extending upward from a respective corner bracket;

a top rail carried by and extending between the pair of posts, the ends of the top rail having eyelets;

at least one cable or strap extending diagonally on opposite sides of the pallet from the eyelets of the top rail to the rings of the proximal and opposite corner brackets; and the frame having:

an expanded use configuration with the corner brackets mounted to the corners of the pallet and configured to receive cargo therein, and a collapsed configuration with the corner brackets removed from the corners of the pallet.

17. The re-usable crate system in accordance with claim 16, wherein each corner bracket further comprises:

a plate receiver in the pocket and extending from one of the walls and defining a gap between the plate receiver and the other wall, the gap sized to receive an end of one of the lateral outer sides of the pallet; and the plate receiver configured to resist movement between the bracket and the pallet in at least one direction.

18. The re-usable crate system in accordance with claim 17, wherein the frame is received in the interior volume of the pallet in the collapsed configuration.

19. The re-usable crate system in accordance with claim 16, further comprising:

a pair of pallets positioned end-to-end;

a pair of joiners coupled between the pair of pallets and removably joining the pair of pallets together to form a single, long pallet;

each joiner comprising a bottom plate proximate bottoms of the pallets, a top plate spaced-apart from the bottom plate and proximate tops of the pallets, and a side wall extending between the top and bottom plates, each joiner forming a box with three contiguous side openings, each joiner having a pocket to receive proximate corners of the pair of pallets, each top plate having a pair of threaded apertures spaced-apart from one another;

each joiner comprising a septum extending between the top and bottom plates and separating the pocket into a pair of pockets; and a pair bolts carried by each joiner, each bolt threaded into the threaded aperture to secure the bolt to the respective joiner, the bolt extend through the top plate and into the pocket and engaging the top of the pallet to secure the joiner to the corner of the pallet, the bolt being rotatable with respect to the joiner to secure and release the joiner and the pallets.

20. A re-usable crate system, comprising:

a pallet having a wood construction with a pair of lateral outer sides, an array of upper slats carried by and fastened to tops of the pair of lateral outer sides and extending between the pair of lateral outer sides, and an array of lower slats fastened to bottoms of the pair of lateral outer sides, the pallet having a width, a length and a height, the width and the length being greater than a height, the pallet having an interior volume defined by the pair of lateral outer sides, the array of upper slats and the array of lower slats that is substantially void, the pallet having lateral openings configured to receive a fork of a fork lift;

a frame removably coupled to the pallet and extending above the pallet to form a crate configured to receive cargo over the pallet and at least partially between the frame; the frame comprising:

corner brackets at each corner of the pallet, each corner bracket comprising a bottom plate proximate a bottom of the pallet, a top plate spaced-apart from the bottom plate and proximate a top of the pallet, and a pair of contiguous side walls extending between the top and bottom plates, the pair of side walls adjoining one another and being oriented at a right angle with respect to one another, each corner bracket forming a box with a pair of contiguous side openings opposite the pair of contiguous side walls, each corner bracket having a pocket to receive a respective corner of the pallet, each top plate having a threaded aperture;

each corner bracket having a plate receiver in the pocket and extending from one of the walls and defining a gap between the plate receiver and the other wall, the gap sized to receive an end of one of the lateral outer sides of the pallet, the plate receiver configured to resist movement between the bracket and the pallet in at least one direction;

rings carried by the corner brackets, each ring secured to a respective corner bracket, each ring having a head, a pair of posts carried by a pair of proximate corner brackets, each post extending upward from a respective corner bracket;

a top rail carried by and extending between the pair of posts, the top rail having fingers that insert into open top ends of the pair of posts, the top rail having a pair of telescoping sections, the ends of the top rail having eyelets;

at least one cable or strap extending diagonally on opposite sides of the pallet from the eyelets of the top rail to the rings of the proximal and opposite corner brackets; and the frame having:

an expanded use configuration with the corner brackets mounted to the corners of the pallet and configured to receive cargo therein, and a collapsed configuration with the corner brackets removed from the corners of the pallet.

* * * * *